US005544694A

United States Patent [19]

Landua et al.

[11] Patent Number: 5,544,694

[45] Date of Patent: Aug. 13, 1996

[54] APPARATUS AND A PROCEDURE FOR SHOT-HOOD CLEANING DURING THE PRODUCTION OF CASTING MOLDS OR CORE PACKETS THAT ARE READY FOR CASTING

[75] Inventors: Werner Landua; Wolfgang Schimpf, both of Mannheim, Germany

[73] Assignee: Adolf Hottinger Maschinenbau GmbH, Mannheim, Germany

[21] Appl. No.: 270,267

[22] Filed: Jul. 5, 1994

[30] Foreign Application Priority Data

Jul. 9, 1993 [DE] Germany ..... 43 22 986.7

[51] Int. Cl.[6] ..... B22C 15/20; B22C 15/23

[52] U.S. Cl. ..... 164/20; 164/19; 164/21; 164/200; 164/201; 164/202

[58] Field of Search ..... 164/158, 200, 164/201, 202, 181, 186, 20, 19, 21; 134/76, 77

[56] References Cited

U.S. PATENT DOCUMENTS

| | | | |
|---|---|---|---|
| 4,135,569 | 1/1979 | Drobnik et al. | 164/158 |
| 4,190,096 | 2/1980 | Teplinsky et al. | 164/158 |
| 4,572,273 | 2/1986 | Katashima | 164/158 |

FOREIGN PATENT DOCUMENTS 2304564 8/1974 Germany .

*Primary Examiner*—Jack W. Lavinder
*Assistant Examiner*—I.- H. Lin
*Attorney, Agent, or Firm*—Bell, Seltzer, Park & Gibson, P.A.

[57] ABSTRACT

An apparatus for cleaning shot hoods during the manufacture of casting molds or core packets that are ready for casting, by means of core shooters or shooting stations, preferably in a linear arrangement, the core shooters in each instance incorporating a shot hood (3) that comprises a shot plate (1) and shot nozzles (2), it being possible to uncouple the shot hood (3) from the core shooter and lay it on a pallet (4) or the like with the shot nozzles (2) pointing downward, characterized by a delivery system (5), a transfer station (6), an emptying station (7), a flushing system (8), a drying system (9), an exit station (10), optionally an inspection station, and a removal system (11), the shot hood (3) that has been laid upon the pallet (4) being moveable from the core shooter to the transfer station (6) by means of the delivery system (5), it then being possible to raise it from the pallet (4) by means of a first manipulator (12) and pivot it through approximately 180° about a horizontal axis (13) and then move it with the shot nozzles (2) pointing upward to the emptying station (7), in which it is emptied, to the flushing system (8), the drying system (9), and then to the exit station (10) where it is pivoted through approximately 180° about a horizontal axis (13), when, with the shot nozzles (2) directed downward, it can be positioned upon a clean pallet (4) and then returned, optionally through the inspection station, by the removal system (11) to the core shooter or to a tool store.

26 Claims, 4 Drawing Sheets

APPARATUS AND A PROCEDURE FOR SHOT-HOOD CLEANING DURING THE PRODUCTION OF CASTING MOLDS OR CORE PACKETS THAT ARE READY FOR CASTING

BACKGROUND OF THE INVENTION

The present invention relates to an apparatus for cleaning shothoods during the production of casting molds or core packets that are ready for casting, by means of core shooters or shooter stations that are preferably arranged in line, each of the core shooters incorporating a shot hood that comprises a shot plate and shot nozzles, it being possible to uncouple the shot hood from the core shooter and lay it on a pallet or the like, with the nozzles pointing downward. In addition, the present invention relates to a procedure for using the apparatus according to the present invention.

In principle, the present invention relates to the field of casting technology. In order to cast shaped pieces, casting cores are in most instances manufactured in separate parts, combined, and then joined together to form a casting mold or a core packet. Then, in order to produce, for example, metal work pieces, these core packets are filled with molten metal, whereafter, in series production, the core packets that are to be filled with molten metal pass through the production line lined up one behind the other.

Apparatuses to manufacture core packets of the type under discussion herein are already known from numerous publications. Solely as an example, reference is made herein to DE-OS 23 04 564. Also known from practice is the fact that the cores that are to be joined together to form a core packet are produced in a production line with a series of core shooters or shooting stations that incorporate a plurality of shot hoods, when the core packet has an additional core added to it at each shooting station that incorporates a shot hood. To this end, the cores are laid on a transit element that passes through the individual shooting stations when, in most instances, this transit element simultaneously serves as the tool lower section of the first shooting station.

The sand that is used to shoot the cores or to make up the core packets is always mixed with binding agent, this causing on the one hand, considerable soiling of the tools—the tool upper section with the ejector blade and the tool lower section—and, on the other hand, the shot hoods—shot plates and shot nozzles. Accordingly, in addition to the tools, the shot hoods also have to be cleaned from time to time and to this end removed from the shooting stations and replaced. In the event that the type of core to be shot is changed, there will also be a tool change as well as a hood change so that the shot hoods that have been replaced will also have to be cleaned. Practice has shown that such a shot-hood change or the subsequent cleaning of the shot hoods is always problematic if fully automatic manufacture and thus fully automatic shot-hood cleaning is attempted. On the one hand, manipulation of the shot hoods is problematic and, on the other hand, the cleaning has to be carried out as quickly as possible, despite complicated handling procedures, although this has to be done without contaminating the environment with the core sand that remains in the shot hoods.

For this reason, it is an object of the present invention to provide an apparatus of the type described in the introduction hereto, and an appropriate procedure, by which rapid and at the same time fully automatic shot-hood cleaning is made possible while avoiding environmental contamination.

SUMMARY OF THE INVENTION

The above and other objects and advantages of the present invention are achieved by the provision of an apparatus and method for cleaning shot hoods of the type comprising a shot plate and shot nozzles extending outwardly from one side of the shot plate, and which are adapted for use in the manufacture of casting molds or core pockets which are fabricated of sand and are ready for casting. The features set out in patent claim 1. According to this, the apparatus according to the present invention is characterized by a delivery system, a transfer station, an emptying station, a flushing system, a drying system, and an exit station, and optionally an inspection station and a removal system. The shot hood may be supported on a pallet which can be brought by means of the delivery system from the core shooter to the transfer station, raised from the pallet by means of a first manipulator and pivoted through approximately 180° about a horizontal axis and then, with the shot nozzles pointing upwards, emptied in the emptying station, brought into the flushing system and the drying system, pivoted through approximately 180° about a horizontal axis in the exit station and then, with the shot nozzles directed downwards, positioned on a pallet that has been cleaned and optionally returned via the inspection station to the core shooter or a tool store by means of the removal system.

The present invention recognizes that completely automatic cleaning of shot hoods as part of the production of casting molds or core packages that are ready for casting is possible in every case if a delivery system, a transfer station, an emptying station, a flushing system, a drying system, an exit station, and optionally an inspection station and a removal system are provided which is to say if these, together, form the apparatus according to the present invention. The pallet, which is provided in order to avoid soiling or to avoid core sand from being scattered beyond the path of movement serves as a support for the shot hoods that are to be cleaned, the shot hoods being laid on the pallets in their working position, i.e., with the shot nozzles pointing downward. The shot hoods that have been laid on the pallets are now brought to the transfer station by means of the delivery system, where they are taken over by a manipulator, i.e., are raised from the pallet. This manipulator brings the shot hoods that are to be cleaned over the emptying station and rotates the shot hood through approximately 180° about a horizontal axis so that, now, the shot nozzles are pointing upward and the opening of the shot hood is unobstructed and is directed downward. When this is done, the sand remaining in the shot hood is emptied into the emptying station. Then, the shot hood is brought to the next station by the same manipulator or is taken over by a second manipulator and subsequently brought to the next station, or, more precisely, to the flushing station. At the flushing station, any core sand adhering to the walls of the shot hood is blasted or flushed off. In the drying system that follows, the shot hood that has been wet by circulating water is dried. Next, using the same or a third manipulator, the shot hood is pivoted through approximately 180° about a horizontal axis in the exit station so that the shot hood is then in the working position, with the shot nozzles directed downward. In a subsequent step, the shot hood is positioned on a pallet, which has been cleaned in a similar manner and, optionally, returned to the core shooter or a tool store, optionally via the inspection station, using the removal system.

With respect to a particular configuration of the delivery system, it is an advantage if this comprise a roller conveyor in which individual rollers or groups of rollers are driven. Other known conveyor systems can also be used.

The transfer station can be in the form of a transfer table that is incorporated between the roller conveyor and the emptying station. The manipulator that is used to grip or manipulate the shot hoods can be moved between the first station—the transfer station—and the last station—the exit station—horizontally as well as vertically. In order that it can rotate the shot hoods about a horizontal axis, preferably through 180°, the manipulator incorporates a gripper system that can be rotated about a horizontal axis. This gripper system has, in its turn, gripper jaws that can be rotated about the horizontal, by means of which the shot hoods can be held, preferably on both sides. In addition, within the framework of a particularly advantageous configuration, the manipulator also incorporates a vibrator system in order to vibrate the shot hoods. This ensure that any sand remaining in the shot hood is loosened or shaken away from the inner wall of the shot hood to the largest possible extent.

With respect to a particular configuration of the emptying station, it is an advantage if this includes a collector container for core sand as well as an outlet for the core sand that has been collected. The collector container could be configured, at least for the most part, in a funnel shape so that the sand that has been emptied always collects at the lowest point of the collector container and can thus be removed and disposed of without a problem.

The next station, which is in the form of a flushing system, incorporates spray heads that work on the shot hood both externally and internally. On the one hand, a plurality of spray heads that surround the shot hood could be provided outside the shot hood and, on the other hand, there could be a type of spray head provided within the hood so as to make optimal flushing or spraying of the shot head possible, both inside and outside. In a further advantageous manner, the spray heads are supplied with circulating water so that the consumption of fresh water is reduced to a minimum.

With respect to the configuration of the flushing system, it also is advantageous if this incorporates a drain that runs into a collector basin and a return that runs from the collector basin to the spray heads, so that the circulating water can be recirculated. To this end, the collector basin in its turn incorporates at least a pump and a filter system to filter the circulating water. In the case of the filtering system, this can be a mechanical filter, for example, or a membrane-type filter. The drying system that follows the flushing system serves to dry the shot hoods that have been wetted with the circulating water and incorporates at least one fan to air-dry the shot hoods. In the event that a plurality of fans is provided, these can be positioned both outside and inside the shot hood so that drying can be effected both on the inside and on the outside. In a further advantageous manner, the air-drying is carried out at approximately 55° C. In place of a single drying system, a total of two drying systems could be incorporated, these following each other in series in order that no super-critical cycle time is caused by the drying process.

In order to provide a simple support or rest for the shot heads, both the flushing system and the drying systems incorporate framework or supporting elements. These framework or supporting elements are arranged and dimensioned in such a way that the shot hoods can be accommodated or held reliably and without the need for any particular centring operations, with the shot nozzles directed upward.

With respect to effectively avoiding any unnecessary damage to the immediate environment around the systems described above, it is of a particular advantage if the flushing system and/or the drying systems can each be covered or closed off by means of a covering cowl. In order to permit loading or unloading the systems in question, it must be possible to remove the covering cowl as quickly as possible and close it prior to the beginning of the working process so that it is largely sealed. To this end, the covering cowls are articulated on pivot arms that are associated with the particular system, and can be operated or pivoted by means of a cylinder-piston arrangement. In other words, each of the covering cowls is operated by a special manipulator. The covering cowls can be pivoted out of the way to one side of the conveyor system for the shot hoods, so that they do not cause any interference. With respect to a particularly simple and, at the same time, space-saving checking of the shot hoods that have been cleaned, it is an advantage if the inspection station is associated with the exit station, especially since the actual cleaning process has already ended at that point. The inspection station that follows the drying system would serve to provide a visual check by an operator. In a particularly advantageous manner, and in particular with respect to completely automated cleaning and monitoring, the inspection station could preferably comprise sensors, preferably of the non-contact type, in order to provide for non-contact scanning of the surface of the shot hood. This sensing could be effected, for example, by visible light, by means of ultrasound, or by using induction processes.

With respect to the pallet that remains once the shot hood has been raised into the transfer station, and with respect to a particularly simple cleaning of these pallets that are contaminated with sand, within the framework of a first alternative, these pallets could be moved to a separate pallet-cleaning path. This pallet-cleaning path could comprise a dedicated conveyor system, a pallet manipulator, and an emptying station, with the pallet being pivoted through approximately 180° about a horizontal axis by means of the pallet manipulator, and then emptied in the emptying station with the load-bearing surface facing downward. The dedicated emptying station provided for the pallets could also incorporate brushes for brushing away any sand adhering to the load-bearing surface of the pallet.

With respect to an alternative configuration that is advantageous with respect, on the one hand, to requiring little space and, on the other hand, with respect to a smaller outlay for apparatus, the manipulator that is used to manipulate the shot hoods could also serve to pick up the pallets that remain on the transfer table once the shot hoods have been lifted. These pallets would then be taken by means of this manipulator to the same emptying station that is used to empty the shot hoods, where they, too, would be emptied. In order to provide for particularly simple cleaning of the pallets, this emptying station could also incorporate a brush, which is preferably moveable, in order to brush off the pallets. The brush could be moved, once again, by means of a cylinder-piston arrangement, so that the brush can move back and forth.

In a particularly advantageous manner, the pallets that have been cleaned could be brought back to the transfer table by means of the manipulator and moved from there to the removal station and thus serve to receive the shot hoods that have been cleaned after the shot-hood cleaning process. To this end, the transfer table of the transfer station would be in the form of an elevator table, preferably as a scissor-leg elevator table. A return track that takes over the cleaned pallet from the transfer table in its lowered position and which leads to the exit station could be arranged beneath the delivery system that serves to deliver the soiled shot hoods on the pallets. The arrangement of the delivery track and the return track one above the other minimizes the amount of space that is required.

The exit station that is adjacent to the last processing station, or the inspection station, could be in the form of a transfer table that acts between the last processing station, the drying system, and the return track, when this can be the same transfer table as the one ahead of the emptying station. The transfer table of the exit station could thus be in the form of an elevating table, in particular of a scissor-leg elevating table.

In a lowered position, the transfer table of the exit station takes over the cleaned pallet from the return track and moves this to the exit station or inspection station, respectively. In a raised position, the shot hood that has been cleaned and which arrives there is then laid on the pallet or taken over by this so that the shot hood that has been cleaned and that is lying on the pallet can be moved off directly to the core shooter or a tool store on a removal track lying in the plane of the raised or lowered position. The removal system also incorporates a roller conveyor in the same way as the delivery system described heretofore.

The shot hood that has been laid on the pallet is moved from the core shooter to the transfer station by means of the delivery system. There, the shot hood is raised from the pallet by the manipulator and brought into the area above the emptying station. At this point, the shot hood is pivoted about a horizontal axis through approximately 180° in order to empty the shot hood that has its shot nozzles directed upward into the emptying station. Subsequently, the shot hood is moved into the flushing system by means of the manipulator and is flushed or blasted, this being done when it is sprayed or blasted with circulating water, both inside and outside. In a subsequent process step, the shot hood is moved by the manipulator into the drying system where the circulating water that is wetting its surfaces is removed. In the following process step, the shot hood is brought to the exit station, which optionally serves as the inspection station, and there pivoted about a horizontal axis through approximately 180° by means of the manipulator so that the shot nozzles are once again directed downward. Thereafter, the shot hood is laid on a pallet that has been cleaned and made ready in the exit station and returned on the pallet—on the removal system—to the core shooter or to a tool store. With respect to particularly effective cleaning of the shot hoods, it is a great advantage if these can be placed in the flushing system by the manipulator with the shot nozzles directed upward. However, when this is done, it must be ensured that the shot hoods are blasted or sprayed on the inside as well. The arrangement of the shot hoods selected here is retained in the subsequent drying system so that the circulating water that is wetting the shot hoods can drip off without restriction. With respect to effective cycling times, two shot hoods are dried simultaneously in two drying systems, in which connection the shot hoods and/or pallets can be cleaned in two or several parallel lines that incorporate apparatuses according to the present invention.

The cleaning of the pallets that has been described heretofore with respect to the apparatus can be completed in two alternative process steps. On the one hand, after the shot heads have been raised, the pallets could be moved to a separate pallet-cleaning path. There, the pallets would be pivoted horizontally through approximately 180° by means of a pallet manipulator and, with the load-bearing surface facing downwards, could be emptied in a dedicated emptying station. Within the emptying station, the sand adhering to the load-bearing surface could be brushed off by brushes. The cleaned pallet could then be moved to the exit station and used at that point to accommodate the cleaned shot hoods.

Alternatively, and with respect to a particularly small space requirement, the pallet that remains on the transfer table after the shot hood has been lifted could also be gripped by the manipulator and moved to the emptying station used to empty the shot hoods so that it, too, can be emptied. The pallet that has been cleaned could be returned to the transfer table by means of the manipulator and moved from there to the exit station, where it could be used to receive the cleaned shot hood. In any case, what is important here is that the manipulator picks up a shot hood and a pallet in turn, so that the manipulation and cleaning of the shot hood and the pallet take place in an alternating sequence. A plurality of manipulators could be provided without any problem so that simultaneous manipulation of both shot hood and pallet is made possible.

The return track that is arranged beneath the delivery system and which leads to the exit station takes over the cleaned pallet from the transfer table when this is in its lowered position and moves the cleaned pallet to the exit station to accept the cleaned shot hood.

The exit station or the inspection station that is provided at that point could be formed between the drying system and the return track as a transfer table. The cleaned pallet would then be taken over from the transfer table of the exit station which is in a lowered position, moved to a return track or return system and then moved to the exit station or inspection station. With the transfer table in a raised position, the cleaned shot hood could be moved onto the pallet. The shot hood, lying on the pallet, would then be moved off together with the pallet to a removal track in the plane of the raised or lowered position, or else returned to the core shooter or a tool store.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENT

Figure 1:
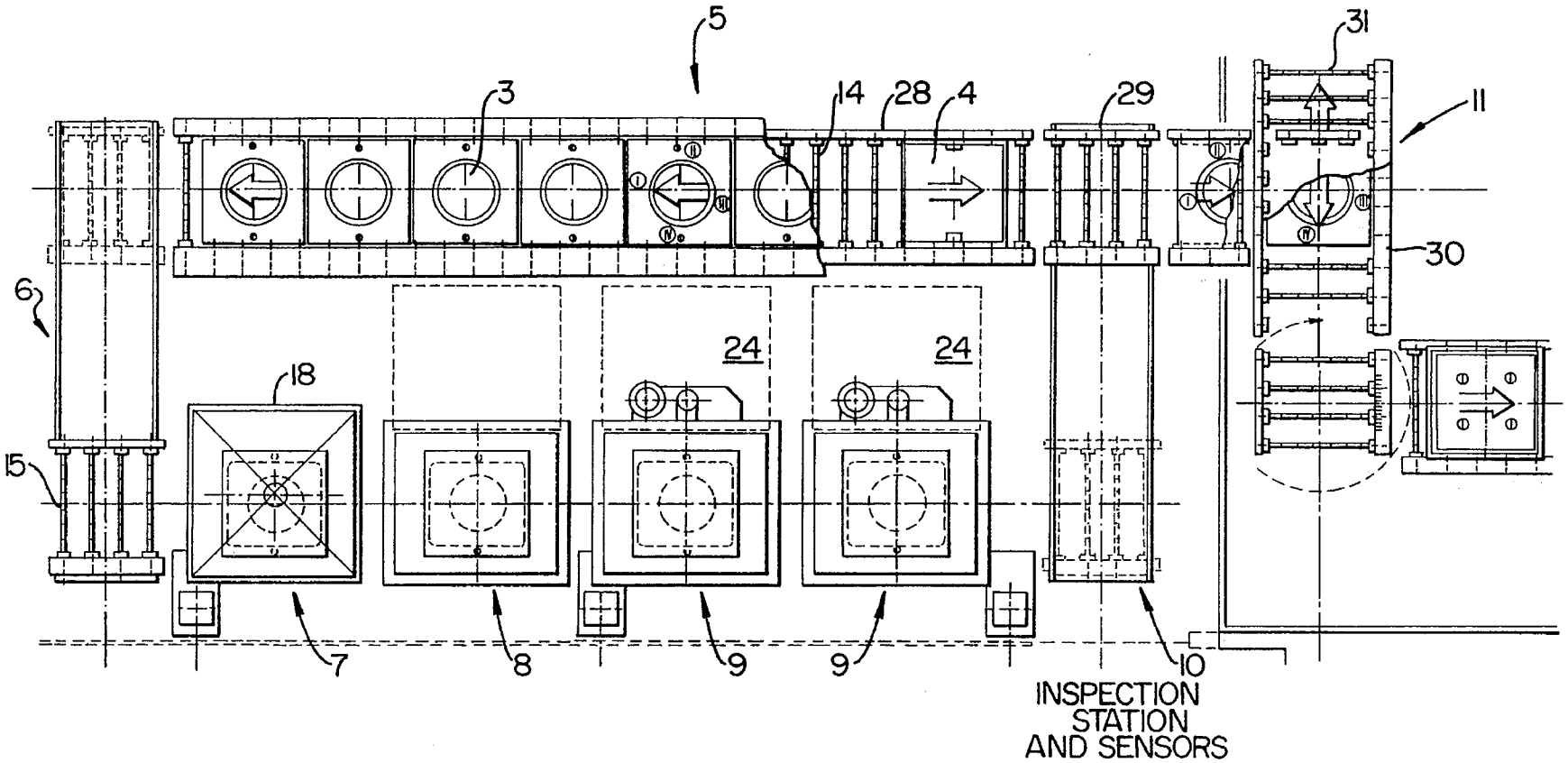
FIG. 1: an embodiment of an apparatus according to the present invention, which is used for shot-hood cleaning, this being shown in plan view.

The FIGS. 1 to 4 show, together, an apparatus for cleaning shot hoods during the manufacture of shells or core packets that are ready for casting, which are usually produced by means of core shooters or shooting stations that are in a linear arrangement. The core shooters incorporate a shot hood 3 that comprises a shot plate 1 and shot nozzles 2. The shot hoods 3 can be uncoupled from the core shooter (now shown in the drawings) and can be laid on a pallet 4 with the shot nozzles 2 pointing downward.

According to the present invention, a delivery system 5, a transfer station 6, an emptying station 7, a flushing system 8, a drying system 9, an exit station 10 that also serves as an inspection station, and a removal system 11 are incorporated. With respect to the features set out above, it is important that the shot hood that is laid on the pallet 4 can be moved by means of the delivery system 5 from the core shooter (not shown in the drawings) to the transfer station 6, lifted from the pallet 4 and rotated through 180° about a horizontal axis 13 by means of the manipulator 12—with the shot nozzles 2 pointing upward—emptied in the emptying station 7, moved into the flushing system 8 and the drying system 9, pivoted through approximately 180° about a horizontal axis 13 in the exit station 10—with the shot nozzles 2 pointing downward-and then positioned on a cleaned pallet 4 and returned via the inspection station with the removal system 11 to the core shooter (not shown herein) or a tool store (not shown herein).

FIG. 1 makes it particularly clear that the delivery system 5 comprises a roller-type conveyor 14. The transfer station 6 is in the form of a transfer table 15 that works between the roller conveyor 14 and the emptying station 7. The manipulator 12 can move between the transfer station 6 and the removal station 10, both horizontally and vertically, which can be seen in FIG. 2. The manipulator 12 also incorporates a gripper system 16 that can traverse about a horizontal axis and which, in its turn, incorporates gripper jaws 17 that can be pivoted about a horizontal axis 13.

Figure 2:
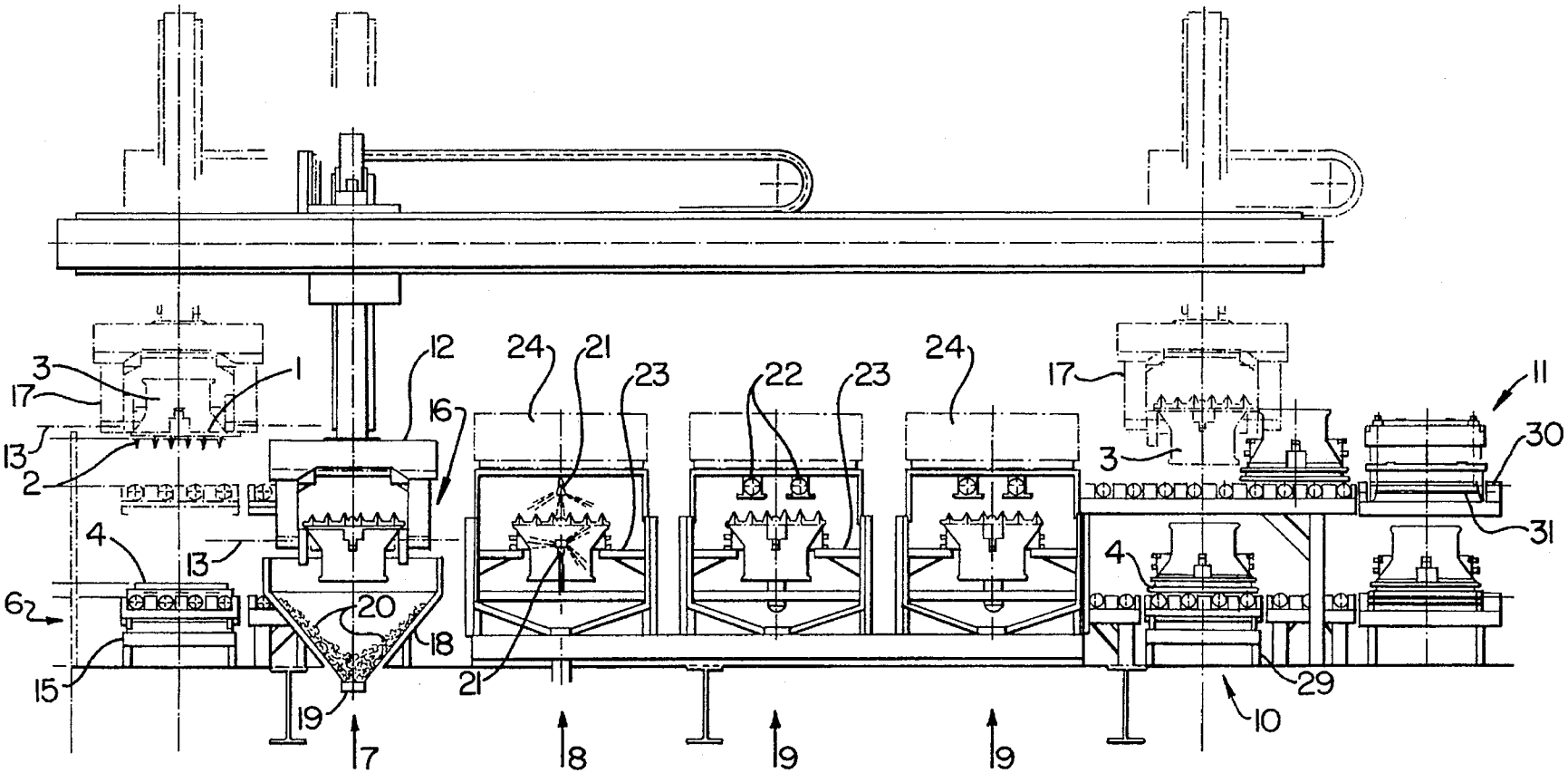
FIG. 2: the apparatus shown in FIG. 1, in side view.
Figure 3:
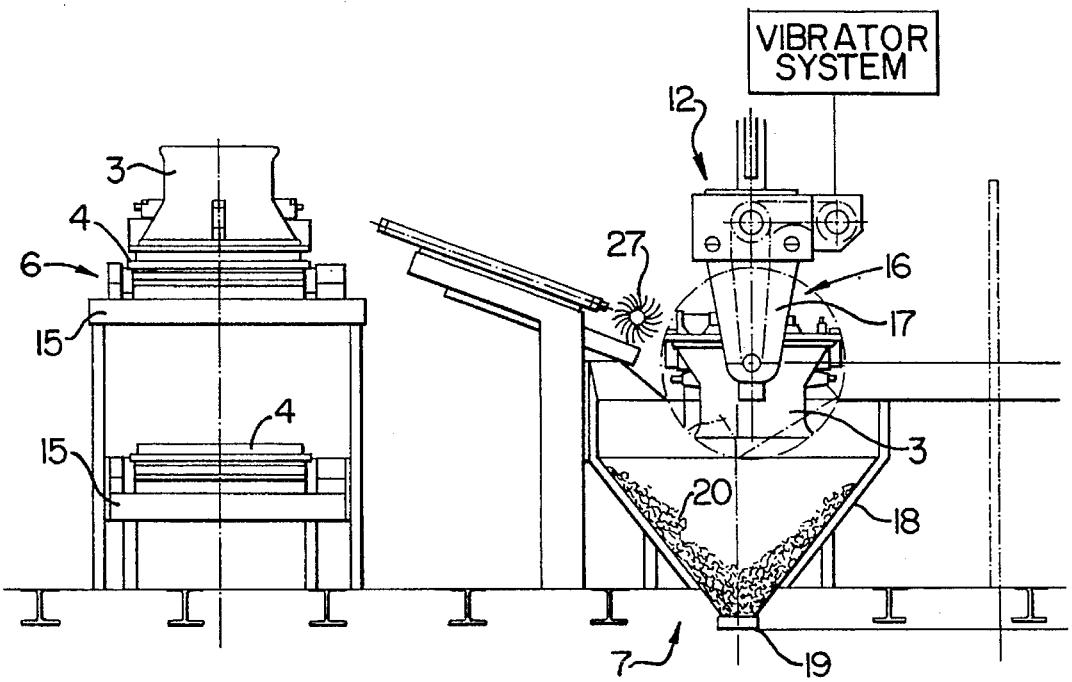
FIG. 3: the apparatus shown in FIG. 1, as viewed from the front, in the area of the emptying system, with a shot hood being emptied.
Figure 4:
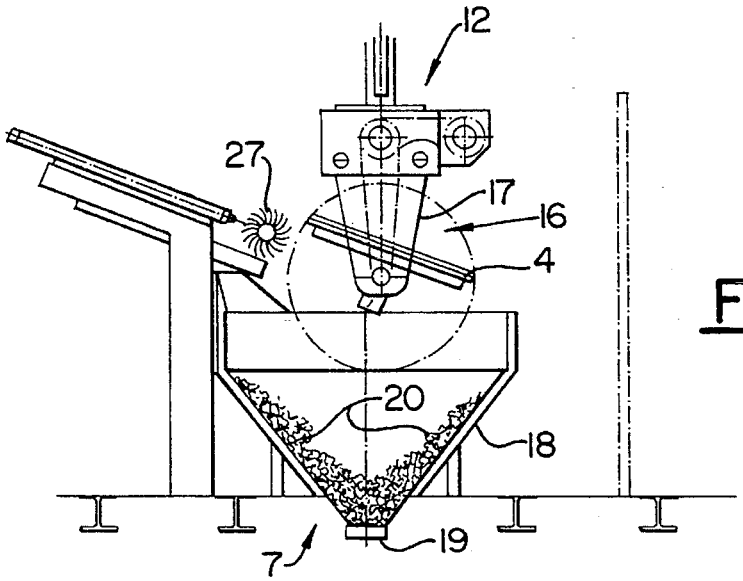
FIG. 4: the apparatus shown in FIG. 1, as viewed from the front, in the area of the emptying system, where a pallet is being emptied.

FIG. 2 shows particularly clearly that the emptying station 7 comprises a collecting container 18 for core sand as well as an outlet 19 for the core sand 20 that has been collected. The collecting container 18 is formed in the shape of a funnel.

In the same way, according to FIG. 2, the flushing system 8 incorporates spray heads 21 that act on the shot hood 3 both externally and internally. These spray heads 21 are supplied with circulating water, which is only indicated in FIG. 2. With respect to these details, reference is made to the general portion of the description.

The drying system 8 incorporates a fan 22 for air-drying the shot hood 3. A total of two drying systems 9, which are arranged adjacent to each other, is provided.

FIG. 2 also shows that the flushing system 8 and the drying systems 9 incorporate frame or supporting elements 23 that are used to receive the shot hoods 3. These frame or supporting elements 23 serve to simplify positioning of the shot hoods 3 that are to be processed, so that no particular centring operation is required.

Figure 5:
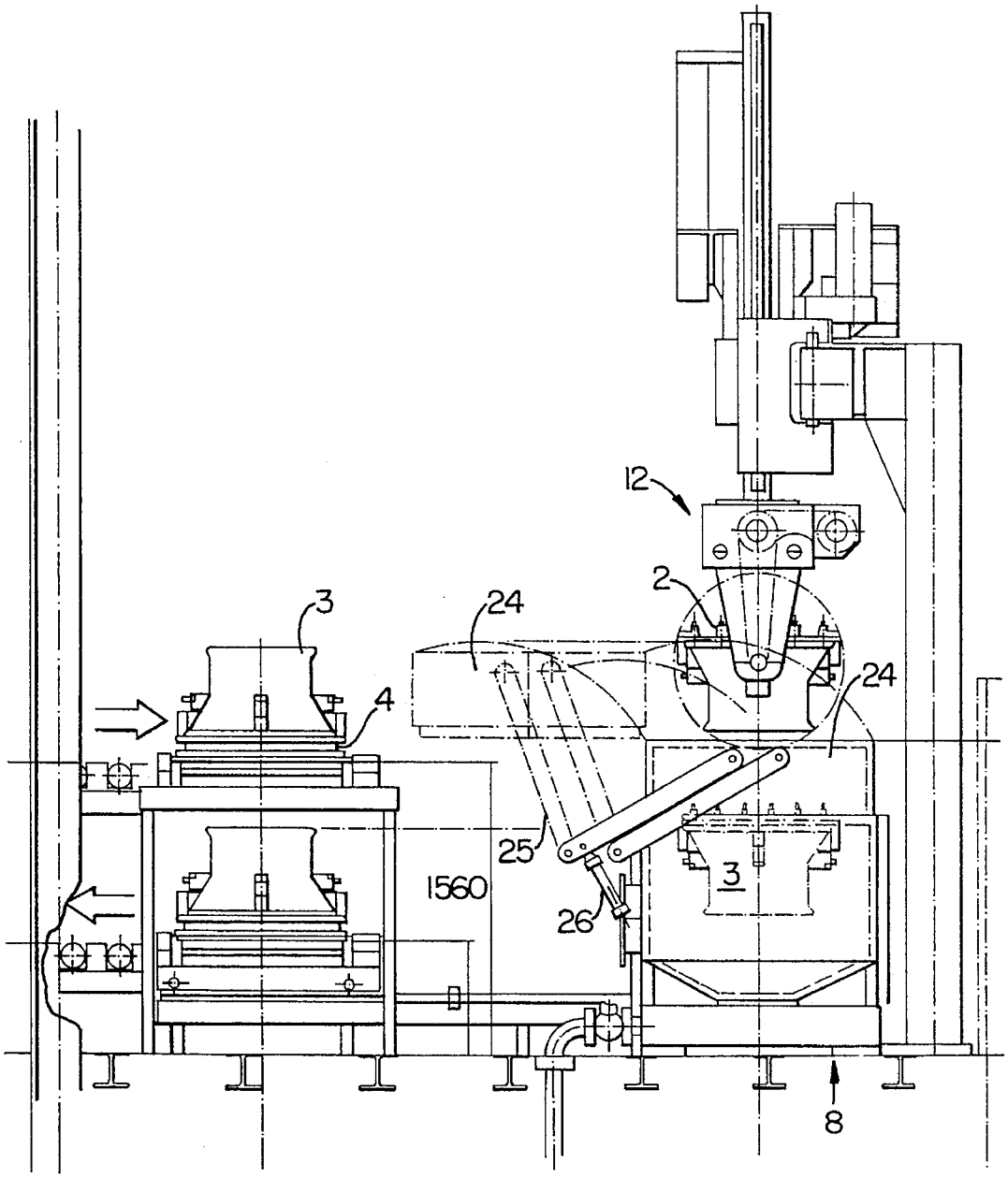
FIG. 5: the apparatus shown in FIG. 1, as viewed from the front, in the area of the flushing system.

FIG. 5 shows particularly clearly and in detail that the flushing system 8 can be covered or closed off by means of a covering cowl 24. The same applies to the drying system 9, which is not shown in FIG. 5. The covering cowl 24 is articulated onto the pivot arms 25 that are associated with the flushing system 8 and can be activated or pivoted by means of a cylinder-piston arrangement 26.

FIG. 1 shows that the inspection station, referred to heretofore, is associated with the exit station 10. The inspection station, which is thus adjacent to the drying system 9, is used to check the quality of cleaning as it applies to the shot hoods 3, on the one hand, and for a basic check of the shot hoods 3, on the other.

In the embodiment selected here, the manipulator 12 that is shown in FIG. 2 is also used to grip the pallet 4 that remains on the transfer table 5 once the shot hood 3 has been lifted. The pallet 4 can be moved to the same emptying station 7 that is used to empty the shot hood 3 in order that it, too, can be emptied, and is moved by means of the manipulator 12. As can be seen from FIGS. 3 and 4, the emptying station 7 has an associated and moveable brush 27 that is used to brush off the pallet 4. The pallet 4 that has been cleaned in this way is returned by the manipulator 12 to the transfer table 15 and from there is moved to the exit station 10, where it is used to accept the shot hood that has been cleaned.

FIGS. 1 and 2 show that the transfer table 15 of the transfer station 6 is configured as a scissor-leg elevator table. Beneath the delivery system 5 there is a return track 28 that takes over the pallet 4 from the transfer table 5 when this is in its lowered position and which leads to the exit station 10. The exit station 10, or the inspection station that is associated with the exit station 10, is in the form of a transfer table 29 that works between the drying system 9 and the return track 28. The transfer table 29 of the exit station 10, like the transfer table 15 in the transfer station 6, is in the form of a scissor-leg elevator table. The transfer table 29 of the exit station 10 takes over the clean pallet 4 from the return track 28 when it is in its lowered position and moves this to the exit station 10 or to the inspection station that is provided there. In a raised position, the cleaned shot hood 3 is then moved onto the pallet 4 so that the shot hood 3 that is lying on the pallet 4 can be moved off or returned by way of a removal track 30 that is located in the plane of the raised or lowered position. The removal system 11 that incorporates the removal track 30 comprises a roller conveyor 31 in the same way as the delivery system 5.

With respect to the procedure according to the present invention, reference is made to the general portion of the description in order to avoid unnecessary repetition.

In conclusion, it should be noted that the preceding example of the teachings according to the present invention, which are referred to only as an example, simply explain these teachings without necessarily being restricted thereto.

We claim:

1. An apparatus for cleaning shot hoods (3) of the type comprising a shot plate (1) and shot nozzles (2) extending outwardly from one side of the shot plate, and which are adapted for use in the manufacture of casting molds or core pockets of sand and that are ready for casting, said apparatus comprising: a delivery system (5); manipulator means (12); a transfer station (6); an emptying station (7); a flushing station (8); a drying station (9); and an exit station (10)

wherein the delivery system (5) for supporting the shot hoods with the nozzles positioned downwardly and for delivering the same to the transfer station (6), the manipulator means (12) for lifting each shot hood from the transfer station and rotating the lifted shot hood through approximately 180° about a horizontal axis so that the nozzles point upwardly, and serially delivering the rotated shot hood to the emptying station (7), the flushing station (8), and the drying station (9), then rotating the shot hood through approximately 180° about the horizontal axis so that the nozzles again point downwardly, and then delivering the shot hood to the exit station (10).

2. The apparatus as defined in claim 1 further comprising noncontact-type sensors positioned at said exit station (10) for scanning the surfaces of the shot hood (3) and thereby inspecting the same.

3. The apparatus as defined in claim 1 wherein the delivery system (5) comprises a roller-type conveyor (14).

4. The apparatus as defined in claim 3 wherein the transfer station (6) is in the form of a transfer table (15) positioned between the roller-type conveyor (14) and the emptying station (7).

5. The apparatus as defined in claim 1 wherein said manipulator means (12) includes a gripper system (16) that is rotatable about a horizontal axis (13).

6. The apparatus as defined in claim 5 wherein said manipulator means (12) further includes a vibrator system for vibrating the shot hood (3).

7. The apparatus as defined in claim 1 further comprising means for transferring pallets (4) for supporting the shot hoods (3) from the transfer station (6) to the exit station (10).

8. The apparatus as defined in claim 7 wherein said manipulator means (12) is configured and adapted for lifting the pallets from the transfer station (6) and rotating the lifted pallet through approximately 180° about a horizontal axis so that the pallet is inverted, and then delivering the inverted pallet to the emptying station (7).

9. The apparatus as defined in claim 8 wherein the emptying station (7) includes a brush (27) to brush off sand (20) that may be adhering to the surface of the pallet (4).

10. The apparatus as defined in claim 1 wherein the transfer station (6) comprises an elevator table.

11. The apparatus as defined in claim 10 further comprising a return track (28) disposed beneath said delivery system (5) for transporting pallets (4) which are configured for supporting the shot hoods, from the elevator table when in its lowered position, and to the exit station (10).

12. The apparatus as defined in claim 11 wherein the exit station (10) comprises a transfer table (29) positioned between the drying station (9) and the return track (28).

13. The apparatus as defined in claim 12 wherein said transfer table (29) of the exit station (10) comprises an elevator table.

14. The apparatus as defined in claim 1 wherein said emptying station (7) includes a funnel-like collector container (18) for receiving core sand (20) which may be released from the shot hood, and an outlet (19) for the core sand that has been collected.

15. The apparatus as defined in claim 14 wherein said flushing system (8) comprises a plurality of spray heads (21) positioned for spraying water on both the outside and the inside of the shot hood (3).

16. The apparatus as defined in claim 15 wherein said flushing station (8) further comprises a collector basin having a drain and a recirculating feed line that leads from the drain of the collector basin to the spray heads (21).

17. The apparatus as defined in claim 15 wherein said drying station (9) includes at least one fan (22) to air dry the shot hood (3).

18. The apparatus as defined in claim 17 wherein said drying station (9) comprises two separate drying systems that are positioned adjacent each other.

19. The apparatus as defined in claim 17 further comprising a covering cowl (24) for covering each of said flushing station (8) and said drying station (9).

20. The apparatus as defined in claim 19 wherein the covering cowl (24) for each of said flushing station (8) and said drying station (9) comprises pivot arms (25) which are operatively pivoted by means of a cylinder-piston arrangement (26).

21. A process for cleaning shot hoods (3) of the type comprising a shot plate (1) and shot nozzles (2) extending outwardly from one side of the shot plate and which are adapted for use in the manufacture of casting molds or core pockets of sand and that are ready for casting, said process comprising the steps of serially delivering the shot hoods with the nozzles positioned downwardly to a transfer station (6), lifting each shot hood from the transfer station and rotating the lifted shot hood through approximately 180° about a horizontal axis so that the nozzles point upwardly, and serially delivering the rotated shot hood to an emptying station (7), a flushing station (8), and a drying station (9), then rotating the shot hood through approximately 180° about the horizontal axis so that the nozzles again point downwardly, and then delivering the shot head to an exit station (10).

22. The method as defined in claim 21 wherein the step of serially delivering the shot hoods to the transfer station includes positioning each shot hood on a supporting pallet (4) which is delivered with the shot hood.

23. The method as defined in claim 22 wherein the step of lifting each shot hood from the transfer station includes separating the shot hood from its supporting pallet.

24. The method as defined in claim 23 comprising the further step of lifting each pallet from the transfer station after the shot hood has been lifted therefrom, and then rotating the lifted pallet through approximately 180° about a horizontal axis so that the pallet is inverted, and delivering the inverted pallet to an emptying station (7) for receiving sand which may fall from the pallet.

25. The method as defined in claim 24 comprising the further step of brushing the lifted and rotated pallet so as to physically remove any sand which is adhering to the surface thereof.

26. The method as defined in claim 24 comprising the further step of moving each cleaned pallet (4) to the exit station (10) so as to be in position to supportingly receive a cleaned shot hood (3).

* * * * *